US006596037B2

(12) United States Patent
Krull et al.

(10) Patent No.: US 6,596,037 B2
(45) **Date of Patent: *Jul. 22, 2003**

(54) FATTY ACID MIXTURES OF IMPROVED LOW-TEMPERATURE STABILITY WHICH COMPRISE COMB POLYMERS, AND THEIR USE IN FUEL OILS

(75) Inventors: Matthias Krull, Oberhausen (DE); Werner Reimann, Frankfurt am Main (DE)

(73) Assignee: Clariant GmbH, Frankfurt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/993,847

(22) Filed: Nov. 16, 2001

(65) Prior Publication Data

US 2002/0099228 A1 Jul. 25, 2002

(30) Foreign Application Priority Data

Nov. 24, 2000 (DE) ..... 100 58 357

(51) Int. Cl.[7] ..... C10L 1/18; C10L 1/22

(52) U.S. Cl. ..... 44/385; 44/393; 44/397; 44/351; 44/340

(58) Field of Search ..... 44/385, 393, 397, 44/351, 340

(56) References Cited

U.S. PATENT DOCUMENTS

| | | | | |
|---|---|---|---|---|
| 4,211,534 A | | 7/1980 | Feldman | |
| 4,670,516 A | | 6/1987 | Sackmann et al. | |
| 5,186,720 A | | 2/1993 | Feustel et al. | |
| 5,376,155 A | | 12/1994 | Dralle-Voss et al. | |
| 5,391,632 A | | 2/1995 | Krull et al. | |
| 6,010,545 A | * | 1/2000 | Davies et al. | 44/389 |
| 6,086,645 A | * | 7/2000 | Quigley et al. | 44/418 |
| 6,129,772 A | | 10/2000 | Weers et al. | |

FOREIGN PATENT DOCUMENTS

| | | |
|---|---|---|
| EP | 0 154 177 | 9/1985 |
| EP | 0 413 279 | 2/1991 |
| EP | 0 597 278 | 5/1994 |
| EP | 0 606 055 | 7/1994 |
| JP | 10-110175 | 4/1998 |
| JP | 11-1692 | 1/1999 |
| WO | 95/33805 | 12/1995 |

OTHER PUBLICATIONS

Japanese Patent Abstract for JP 10–110175, Apr. 28, 1998.
Japanese Laid–open Publication No. Hei–10–110175 Apr. 28, 1998.
Japanese Laid–open Patent Publication No. Hei 11–1692 Jan. 6, 1999.
H.A. Spikes, "The Lubricity of Diesel Fuels", Wear, 111 (1986) p. 217–235.
German office action corresponding to DE Application No. 10058357, Mar. 8, 2001.
U.S. patent application Ser. No. 09/993,590, filed Nov. 16, 2001.

* cited by examiner

*Primary Examiner*—Cephia D. Toomer
(74) *Attorney, Agent, or Firm*—Richard P. Silverman

(57) ABSTRACT

The invention relates to low-temperature-stabilized fatty acid mixtures comprising A) from 10 to 99.99% by weight of fatty acid mixtures comprising: A1) from 1 to 99% by weight of at least one saturated mono- or dicarboxylic acid having 6 to 50 carbon atoms, A2) from 1 to 99% by weight of at least one unsaturated mono- or dicarboxylic acid having 6 to 50 carbon atoms, and B) from 0.01 to 90% by weight of copolymers comprising: B1) from 40 to 60 mol % of bivalent structural units of the formula B1 a)

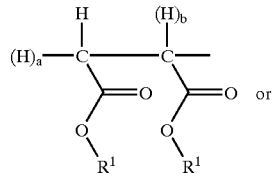

or

B1 b)

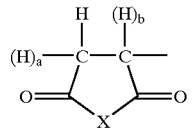

where X=O or N—$R^1$, in which a and b=0 or 1 and a+b=1, and B2) from 60 to 40 mol % of bivalent structural units of the formula $$—H_2C—CR^2R^3—$$ B2 and, if desired, B3) from 0 to 20 mol % of bivalent structural units derived from polyolefins, where the polyolefins can be derived from monoolefins having 3 to 5 carbon atoms, and in which a) $R^1$ is an alkyl or alkenyl radical having from 10 to 40 carbon atoms or an alkoxyalkyl radical having from 1 to 100 alkoxy units and from 1 to 30 carbon atoms in the alkyl radical, and b) $R^3$ is a radical of the formula $OCOR^4$ or $COOR^4$, in which $R^4$ is $C_1$–$C_{24}$-alkyl, and c) the number of carbon atoms in the polyolefin molecules on which the structural units B3) are based is from 35 to 350, and d) $R^2$ is hydrogen or methyl, and to the use of these mixtures for improving the lubrication properties of low-sulfur middle distillates.

9 Claims, No Drawings

FATTY ACID MIXTURES OF IMPROVED LOW-TEMPERATURE STABILITY WHICH COMPRISE COMB POLYMERS, AND THEIR USE IN FUEL OILS

BACKGROUND OF THE INVENTION

The present invention relates to mixtures of fatty acids and comb polymers of improved low-temperature stability, and to their use for improving the lubricity of middle-distillate fuel oils.

1. Field of the Invention

Mineral oils and mineral-oil distillates which are used as fuel oils generally comprise 0.5% by weight or more of sulfur, which causes the formation of sulfur dioxide on combustion. In order to reduce the resultant environmental pollution, the sulfur content of fuel oils is constantly being reduced further. The EN 590 standard, which relates to diesel fuels, currently prescribes a maximum sulfur content of 350 ppm in Germany. In Scandinavia, fuel oils containing less than 50 ppm and in exception cases less than 10 ppm of sulfur are already in use. These fuel oils are generally produced by subjecting the fractions obtained from crude oil by distillation to reductive refining. During desulfurization, however, other substances are also removed which give the fuel oils a natural lubricity. These substances include, inter alia, polyaromatic and polar compounds.

However, it has now been found that the friction-and wear-reducing properties of fuel oils become worse with increasing degree of desulfurization. These properties are frequently so unsatisfactory that corrosion phenomena must be expected after only a short time on the materials lubricated by the fuel, such as, for example, distributor injection pumps of diesel engines. The maximum value for a 95% distillation point of a maximum of 360° C. which has been prescribed in EN 590 since the year 2000 and the further reduction in the 95% distillation point to below 350° C. and in some cases below 330° C. which has in the meantime been effected in Scandinavia intensify these problems further.

2. Description of the Related Art

The prior art has therefore described approaches which are intended to represent a solution to this problem (so-called lubricity additives).

JP-A-Hei-11-1692 discloses fuel-oil compositions comprising from 0.001 to 0.5% by weight of a $C_8$–$C_{30}$-fatty acid mixture which comprises at least 75% by weight of unsaturated fatty acids having one and two double bonds, where the ratio between monounsaturated and diunsaturated fatty acids is from 1:3 to 15:1 by weight, and the fuel-oil composition comprises at most 0.2% by weight of sulfur and at most 40% by weight of aromatic compounds. The oils may comprise further additives, such as antioxidants and flow improvers.

JP-A-Hei-10-110 175 discloses additives for improving the lubricity of fuel oils. The additives comprise a fatty acid selected from straight-chain saturated or unsaturated $C_8$–$C_{28}$-fatty acids, and a pour point depressant or a cold-flow improver. The fuel oils have a maximum sulfur content of 0.05% by weight.

The fatty acids used in accordance with the prior art have the disadvantage that they solidify on storage at low temperatures, i.e. often at room temperature, usually at temperatures of from 0° C. to at the latest −5° C., or deposit crystalline fractions and cause problems in handling. This problem can only be partially solved even by dilution with organic solvents, since fractions also crystallize from these solutions or the solution gels and solidifies. For use as lubricity additives, they therefore have to be diluted to a great extent or stored in heated storage containers and dispensed via heated lines. The additive mixtures proposed in JP-A-Hei-10-110 175 have the problem of the high proportions of pour point depressants or cold-flow improvers which are necessary for the preferred fatty acids, and the resultant high viscosity or poor solubility of these additives, which result in clouding or gelling of the concentrates at low storage temperatures.

SUMMARY OF THE INVENTION

The object on which the present invention is based was to find lubricity additives which improve the lubricity of middle distillates at reduced dispensing rates, but remain homogeneous, clear and in particular flowable even at low temperatures.

Surprisingly, it has been found that mixtures of fatty acids with comb polymers remain flowable and clear for an extended time even at significantly reduced temperatures, in some cases down to below −20° C., in particular cases down to below −30° C. and in special cases down to below −40° C., and in addition improve the lubricity of middle distillates more efficiently than pure fatty acids of the prior art.

DETAILED DESCRIPTION OF THE INVENTION

The invention thus relates to low-temperature-stabilized fatty acid mixtures comprising from 10 to 99.99% by weight of fatty acid mixtures comprising A1) from 1 to 99% by weight of at least one saturated mono- or dicarboxylic acid having 6 to 50 carbon atoms, A2) from 1 to 99% by weight of at least one unsaturated mono- or dicarboxylic acid having 6 to 50 carbon atoms, and from 0.01 to 90% by weight of copolymers comprising B1) from 40 to 60 mol % of bivalent structural units of the formula B1 a)

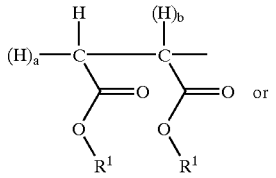

B1 b)

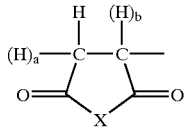

where X=O or N—$R^1$, in which a and b=0 or 1 and a+b=1, and

B2) from 60 to 40 mol % of bivalent structural units of the formula $$—H_2C–CR^2R^3—B2$$

and, if desired,

B3) from 0 to 20 mol % of bivalent structural units derived from polyolefins, where the polyolefins can be derived from monoolefins having 3 to 5 carbon atoms, and in which $R^1$ is an alkyl or alkenyl radical having from 10 to 40 carbon atoms or an alkoxyalkyl radical having from 1 to 100 alkoxy units and from 1 to 30 carbon atoms in the alkyl radical, and $R^3$ is a radical of the formula $OCOR^4$ or $COOR^4$, in which $R^4$ is $C_1$–$C_{24}$-alkyl, and the number of carbon atoms in the polyolefin molecules on which the structural units B3) are based is from 35 to 350, and $R^2$ is hydrogen or methyl.

The invention also relates to low-temperature-stabilized solutions of the fatty acid mixtures according to the invention in solvents, such as, for example, aliphatic and/or aromatic hydrocarbons or hydrocarbon mixtures, and oxygen-containing hydrocarbons, or mixtures thereof. The fatty acid mixtures according to the invention preferably comprise 1–80%, especially 10–70%, in particular 25–60%, of solvent.

The invention furthermore relates to fuel oils comprising, in addition to a relatively large proportion of middle distillate having a sulfur content of up to 0.05% by weight, a relatively small proportion of a low-temperature-stabilized fatty acid mixture as defined above.

The invention furthermore relates to the use of said fatty acid mixtures comprising constituents A and B for improving the lubrication properties of low-sulfur middle distillates having a sulfur content of up to 0.05% by weight.

Preferred fatty acids (constituent A) are those having 8–40 carbon atoms, in particular 12–22 carbon atoms. The alkyl radicals in the fatty acids essentially consist of carbon and hydrogen. However, they may carry further substituents, such as, for example, hydroxyl, halogen, amino or nitro groups, so long as these do not impair the predominant hydrocarbon character.

Constituent A2) may contain one or more double bonds and be of natural or synthetic origin. In the case of polyunsaturated carboxylic acids, their double bonds may be isolated or conjugated. The proportion of saturated fatty acids A1) in the mixture of A1) and A2) is preferably less than 20% by weight, in particular less than 10% by weight, especially less than 5% by weight. In preferred fatty acid mixtures, which is taken to mean the combination of A1) and A2) here, at least 50% by weight, in particular at least 75% by weight, especially at least 90% by weight, of the constituents contain one or more double bonds. These preferred fatty acid (mixtures) have iodine numbers of at least 40 g of l/100 g, preferably at least 80 g of l/100 g, in particular at least 125 g of l/100 g.

Examples of suitable fatty acids are lauric, tridecanoic, myristic, pentadecanoic, palmitic, margaric, stearic, isostearic, arachic and behenic acid, oleic and erucic acid, palmitoleic, myristoleic, linoleic, linolenic, elaeosteric and arachidonic acid, ricinoleic acid and fatty acid mixtures obtained from natural fats and oils, such as, for example, coconut oil, groundnut oil, fish, linseed oil, palm oil, rape oil, ricinene oil, castor oil, colza oil, soya oil, sunflower oil and tall oil fatty acid.

Likewise suitable are dicarboxylic acids, such as dimeric fatty acids and alkyl- and alkenylsuccinic acids containing $C_8$–$C_{50}$-alk(en)yl radicals, preferably containing $C_8$–$C_{40}$-, in particular containing $C_{12}$–$C_{22}$-alkyl radicals. The alkyl radicals may be linear or branched (oligomerized alkene, PIB).

The fatty acids may furthermore comprise 1–40% by weight, especially 1–25% by weight, of resin acids, based on the weight of A1) and A2) together.

The structural units in the compounds based on the formula B1) are derivatives of maleic, fumaric or itaconic acid. $R^1$ is preferably an alkyl radical having preferably from 10 to 24, in particular from 12 to 20, carbon atoms.

Preferred alcohols $R^1$—OH are, for example, 1-decanol, 1-dodecanol, 1-tridecanol, isotridecanol, 1-tetradecanol, 1-hexadecanol, 1-octadecanol, eicosanol, docosanol, tetracosanol, mixtures thereof, and naturally occurring mixtures, such as, for example, coconut fatty alcohol, tallow fatty alcohol and behenyl alcohol. The alcohols may be of natural or synthetic origin.

Besides the use of individual alcohols $R^1$—OH for the esterification, the use of alcohol mixtures, for example of dodecanol and tetradecanol or tetradecanol and hexadecanol in a ratio of from 1:10 to 10:1, in particular from 3:1 to 1:3, has proven particularly successful here. Through variation of the alcohol components, the additive can be matched to the fatty acid to be treated. Thus, for example, addition of, for example, 15% by weight of behenyl alcohol to above-mentioned mixtures enables the effectiveness in fatty acids having a relatively high proportion of saturated, in particular saturated $C_{18}$- and $C_{20}$-fatty acids to be optimized. The radicals $R^1$ may be linear or branched, where the branch may include a secondary or tertiary carbon atom. Linear radicals $R^1$ are preferred. If $R^1$ is branched, it preferably carries this branch in the 2-position. It is possible to use different radicals $R^1$, i.e. to employ different alcohols in the preparation of the maleic acid, itaconic acid and/or fumaric acid ester mixtures.

In a further preferred embodiment, the radicals $R^1$ in the formula B1) are alkoxyalkyl radicals of the formula $$(O—A)_x—R^5$$

in which A is a $C_2$–$C_4$-alkylene radical, x is an integer from 1 to 100, and $R^5$ is a $C_1$–$C_{30}$-alkyl radical. The (O—A) unit is preferably an ethoxy or propoxy unit. If alkoxylated units are used for $R^1$, this preferably takes place in a mixture with radicals $R^1$ which are not alkoxylated. The proportion of alkoxylated radicals $R^1$ preferably does not exceed 20 mol % (based on all radicals $R^1$). $R^5$ may be linear or branched. If $R^5$ is branched, the branch is preferably in the 2-position. $R^5$ is preferably linear.

Primary amines having from 12 to 30 carbon atoms, in particular from 12 to 22 carbon atoms, such as dodecylamine, tetradecylamine, hexadecylamine, octadecylamine and eicosylamine, and mixtures thereof, such as coconut fatty amine and tallow fatty amine, have proven particularly suitable for the imidation (structural units B1b).

The structural units of the formula B2) are derived firstly from α-olefins. These α-olefins preferably have from 10 to 40 carbon atoms, in particular from 12 to 26 carbon atoms. $C_{14}$–$C_{24}$-α-olefins are particularly preferred. The carbon chain of the α-olefins may be straight-chain or branched, preferably straight-chain. Examples of suitable olefins are 1-dodecene, 1-tetradecene, 1-tridecene, 1-hexadecene, 1-heptadecene, 1-octadecene, 1-nonadecene, 1-eicosene, 1-hemicosene, 1-docosene, 1-tetracosene, 1-hexacosene, 1-octacosene, etc., and mixtures thereof. Commercially available olefin fractions, such as, for example, $C_{20}$–$C_{24}$- or $C_{30+}$-olefin, are likewise suitable.

The structural units of the formula B2) are furthermore derived from vinyl, acrylic or methacrylic acid esters containing alkyl radicals carrying from 1 to 3 carbon atoms. Particular preference is given to structural units B2) which are derived from vinyl acetate or vinyl propionate.

The bivalent structural units mentioned under B3) are derived from polyolefins which are derived from monoolefins having 3, 4 or 5 carbon atoms. Particularly preferred monoolefins as parent structures of the polyolefins are propylene and isobutylene, from which polypropylene and polyisobutylene are formed as polyolefins. The polyolefins preferably have an alkylvinylidene content of at least 50 mol %, in particular of at least 70 mol %, especially at least 75%. The polyolefins which are not susceptible to free-radical polymerization generally remain in the product as non-copolymerized constituents, which also has a positive effect on the solubility and effectiveness of the polymers. The term alkylvinylidene content is taken to mean the content in the polyolefins of structural units based on compounds of the formula

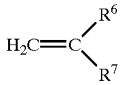

in which $R^6$ or $R^7$ is methyl or ethyl, and the other group is an oligomer of the $C_3$–$C_5$-olefin. The number of carbon atoms in the polyolefin is from 35 to 350. In the preferred embodiment of the invention, the number of carbon atoms is from 45 to 250. In a further preferred embodiment of the invention, the proportion of structural units B3) is from 1 to 20 mol %, in particular from 2 to 15 mol %.

The polyolefins on which the structural units B3) are based can be obtained by ionic polymerization and are available as commercial products (for example ®Ultravis, ®Napvis, ®Hyvis, ®Glissopal) (polyisobutenes from BP and BASF having various alkylvinylidene contents and molecular weights.

The mean molecular weight of the copolymers B) according to the invention is generally from 1500 to 200,000 g/mol, in particular from 2000 to 100,000 g/mol (GPC against polystyrene standard in THF).

The copolymers B) according to the invention are preferably prepared at temperatures of from 50 to 220° C., in particular from 100 to 190° C., especially from 130 to 170° C. The preferred preparation process is solvent-free bulk polymerization, but it is also possible to carry out the polymerization in the presence of aromatic, aliphatic or isoaliphatic aprotic solvents, such as hexane, cyclohexane, toluene, xylene or of solvent mixtures, such as kerosine or solvent naphtha. In the case of solution polymerization, the temperature can be set particularly simply through the boiling point of the solvent or by working under subatmospheric or superatmospheric pressure.

The reaction of the monomers is initiated by free-radical-forming initiators (free-radical chain starters). This class of substances includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl) peroxide carbonate, t-butyl perpivalate, t-butyl permaleate, t-butyl perbenzoate, dicumyl peroxide, t-butyl cumyl peroxide, di(t-butyl) peroxide, 2,2'-azobis(2-methyl-propanonitrile) or 2,2'-azobis(2-methylbutyronitrile). The initiators are employed individually or as a mixture of two or more substances in amounts of from 0.01 to 20% by weight, preferably from 0.05 to 10% by weight, based on the monomer mixture.

The copolymers can be prepared by copolymerization of olefin and/or unsaturated ester (component B2) and, if desired, polyolefin (component B3) with either maleic acid, fumaric acid, itaconic acid, itaconic anhydride or maleic anhydride or maleic ester, fumaric ester or itaconic ester or maleimide or itaconimide (component B1). If a copolymerization is carried out with acids or anhydrides, the resultant copolymer is esterified or imidated after the preparation. This esterification or imidation is carried out, for example, by reaction with from 1.5 to 2.5 mol of alcohol or from 0.8 to 1.2 mol of amine per mol of annydride at from 50 to 300° C., in particular 120–250° C. The reaction water can be distilled off by means of a stream of inert gas or removed by azeotropic distillation. Copolymers B) having acid numbers of less than 50 mg of KOH/g, in particular less than 30 mg of KOH/g, especially less than 20 mg of KOH/g, are preferred.

The comonomers B1 and B2 are preferably employed in equimolar amounts. The proportion of comonomers B3 is preferably from 0.5 to 10 mol %, in particular from 1 to 5 mol %.

The mixing ratio between A and B can vary within broad limits. Thus, even small amounts of B of from 100 ppm to 50,000 ppm, preferably from 1000 ppm to 10,000 ppm, in fatty acid solutions act as low-temperature additive for A. They are capable of suppressing the inherent crystallization of the fatty acid, which results in a reduction in the cloud point, and, where appropriate, prevents the sedimentation of crystals formed and thus facilitates easy handling at reduced temperatures. For specific problem solutions, however, from 5% to 50%, in particular cases up to 90%, of constituent B, based on the amount of constituent A, may also be present. In particular, the inherent pour point of the additive is lowered and the lubricity of the additive-containing oil is improved. Accordingly, the preferred mixing ratio of A:B is form 1:10 to 1:0.0001, in particular from 1:4 to 1:0.0005, especially from 1:1 to 1:0.001.

The fatty acid mixtures according to the invention are added to oils in amounts of from 0.001 to 0.5% by weight, preferably from 0.001 to 0.1% by weight. They can be employed as such or also dissolved in solvents, such as, for example, aliphatic and/or aromatic hydrocarbons or hydrocarbon mixtures, such as, for example, toluene, xylene, ethylbenzene, decane, pentadecane, gasoline fractions, kerosine or commercial solvent mixtures, such as solvent naphtha, ®Shellsol AB, ®Solvesso 150, ®Solvesso 200, ®Exxsol, ®Isopar and ®Shellsol D grades. Suitable solvents are also oxygen-containing hydrocarbons. The fatty acid mixtures according to the invention preferably comprise 1–80%, especially 10–70%, in particular 25–60%, of solvent. The fatty acid mixtures, which can also be employed without problems at low temperatures of, for example, 0° C., in some cases also below −20° C. and in special cases at −40° C. or lower, improve the lubricity of the additive-containing oils and their low-temperature and corrosion-protection properties.

For the preparation of additive packages for special problem solutions, the fatty acid mixtures according to the invention may also be employed together with one or more oil-soluble co-additives which, even on their own, improve the low-temperature flow properties and/or lubricity of crude oils, lubricating oils or fuel oils. Examples of co-additives of this type are vinyl acetate-containing copolymers or terpolymers of ethylene, paraffin dispersants and alkylphenol-aldehyde resins.

Thus, mixtures of the fatty acid mixtures according to the invention with copolymers which comprise from 10 to 40% by weight of vinyl acetate and from 60 to 90% by weight of ethylene have proven highly successful. According to a further embodiment of the invention, the fatty acid mixtures according to the invention are employed as a mixture with ethylene-vinyl acetate-vinyl neononanoate terpolymers or ethylene-vinyl acetate-vinyl neodecanoate terpolymers for improving the flow properties of mineral oils or mineral oil distillates. Besides ethylene, the terpolymers of vinyl neononanoate or of vinyl neodecanoate comprise from 10 to 35% by weight of vinyl acetate and from 1 to 25% by weight of the respective neo compound. Besides ethylene and from 10 to 35% by weight of vinyl esters, further preferred copolymers also comprise from 0.5 to 20% by weight of olefin, such as diisobutylene, 4-methylpentene or norbornene. The mixing ratio of the fatty acid mixtures according to the invention with the ethylene-vinyl acetate copolymers described above or the terpolymers of ethylene, vinyl acetate and the vinyl esters of neononanoic or of neodecanoic acid is (in parts by weight) from 20:1 to 1:20, preferably from 10:1 to 1:10.

Furthermore, the fatty acid mixtures according to the invention can be employed as a mixture with paraffin dispersants. Paraffin dispersants reduce the size of the paraffin crystals and have the effect that the paraffin particles do not settle out, but instead remain dispersed in colloidal form with significantly reduced sedimentation volition. Furthermore, they increase the lubricity of the fatty acid mixtures according to the invention. Paraffin dispersants which have proven successful are oil-soluble polar compounds containing ionic or polar groups, for example amine salts and/or amides, which are obtained by reaction of aliphatic or aromatic amines, preferably long-chain aliphatic amines, with aliphatic or aromatic mono-, di-, tri- or tetracarboxylic acids or anhydrides thereof (cf. U.S. Pat. No. 4,211,534). Similarly, products of the reaction of nitrogen-containing polycarboxylic acids with long-chain amines are suitable (cf. EP 0597278). Other paraffin dispersants are copolymers of maleic anhydride and α,β-unsaturated compounds, which can likewise be reacted with primary monoalkylamines and/or aliphatic alcohols (cf. EP 0 154 177), the products of the reaction of alkenylspirobislactones with amines (cf. EP 0 413 279 B1) and, in accordance with EP 0 606 055 A2, products of the reaction of terpolymers based on α,β-unsaturated dicarboxylic anhydrides, α,β-unsaturated compounds and polyoxyalkylene ethers of lower unsaturated alcohols. Alkylphenol-aldehyde resins are also suitable as paraffin dispersants.

The fatty acid mixtures according to the invention can thus be employed together with alkylphenol resins. In a preferred embodiment of the invention, these are alkylphenol-formaldehyde resins, for example of the formula

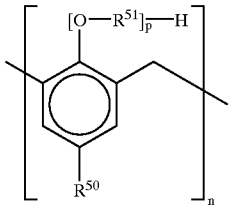

in which $R^{50}$ is $C_4$–$C_{50}$-alkyl or -alkenyl, $R^{51}$ is ethoxy and/or propoxy, n is a number from 5 to 100, and p is a number from 0 to 50.

The mixing ratio of the fatty acid mixtures according to the invention with the above-described paraffin dispersants and alkylphenol resins is (in parts by weight) from 20:1 to 1:20, preferably from 10:1 to 1:10.

The fatty acid mixtures according to the invention are suitable for improving the lubrication properties of animal, vegetable, mineral or synthetic fuel oils with only low dispensing rates. Their improved low-temperature properties make warming and/or dilution during storage and use unnecessary. In addition, they simultaneously improve the low-temperature and corrosion-protection properties of the additive-containing oils. Furthermore, the emulsification properties of the additive-containing oils are impaired less than is the case with the lubrication additives from the prior art. The fatty acid mixtures according to the invention are particularly suitable for use in middle distillates. The term middle distillates is taken to mean, in particular, mineral oils which are obtained by distillation of crude oil and boil in the range from 120 to 450° C., for example kerosine, jet fuel, diesel and heating oil. The oils may also comprise or consist of alcohols, such as methanol and/or ethanol. The fatty acid mixtures according to the invention are preferably used in middle distillates which contain 0.05% by weight or less of sulfur, particularly preferably less than 350 ppm of sulfur, in particular less than 200 ppm of sulfur and in special cases less than 50 ppm of sulfur. In general, these are middle distillates which have been subjected to reductive refining and which therefore only contain small proportions of polyaromatic and polar compounds which give them a natural lubricity. The fatty acid mixtures according to the invention are furthermore preferably used in middle distillates which have 95% distillation points below 370° C., in particular 350° C. and in special cases below 330° C. They can also be employed as components in lubricating oils.

The mixtures can be used alone or also together with other fatty acid mixtures, for example with other pour point depressants or dewaxing auxiliaries, with corrosion inhibitors, antioxidants, sludge inhibitors, dehazers, conductivity improvers, lubricity additives and additives for lowering the cloud point. They are furthermore successfully employed together with additive packages which comprise, inter alia, known ash-free dispersion additives, detergents, antifoams and corrosion inhibitors.

The improved low-temperature stability and the effectiveness of the fatty acid mixtures according to the invention as lubricity additives is explained in greater detail by the following examples.

EXAMPLES

The following substances were employed:

A1) Tall oil fatty acid comprising, as principal constituents, 30% of oleic acid, 60% of linoleic acid and other polyunsaturated fatty acids and 4% of saturated fatty acids. Iodine number 155 g of l/100 g A2) Oleic acid (technical-grade) comprising, as principal constituents, 53% of oleic acid, 24% of linoleic acid and 16% of saturated fatty acids. Iodine number 94 g of l/100 g.

B1) Product of the reaction of a terpolymer of $C_{18}$-α-olefin, maleic anhydride and polyisobutylene (Mw about 1300 g/mol) with tetradecanol and behenyl alcohol, 50% in solvent naphtha B2) Copolymer of di-$C_{14}$/$C_{16}$-alkyl fumarate and vinyl acetate, 50% in solvent naphtha B3) Stearylamine-imidated copolymer comprising equal parts of maleic anhydride and octadecene, 50% in solvent naphtha B4) Mixture of equal parts of copolymer comprising equal parts of di(tetradecyl) fumarate and vinyl acetate and amide ammonium salt comprising 1 mol of phthalic anhydride and 2 mol of disallow fatty amine, 50% in solvent naphtha.

In order to assess the low-temperature properties, the cloud point of the fatty acid mixtures according to the invention was measured in accordance with ISO 3015 (Table 1). The fatty acid mixtures were then stored at various temperatures for a number of days and then assessed visually (Table 2). C denotes comparative examples.

TABLE 1

Inherent pour points (cloud point) of the fatty acid mixtures according to the invention

| Example | Composition: Fatty acid | Comb polymer | Solvent | Cloud point |
|---|---|---|---|---|
| 1 | A1 | 500 ppm B1 | 50% naphtha | −35.0°C. |
| 2 | A1 | 2000 ppm B1 | 50% naphtha | −34.0°C. |
| 3 | A1 | 5000 ppm B1 | 50% naphtha | −34.2°C. |
| 4 | A1 | 2000 ppm B4 | 50% naphtha | −37.0°C. |
| 5 | A2 | 2000 ppm B1 | 50% naphtha | 0.3°C. |
| 6 | A2 | 5000 ppm B1 | 50% naphtha | −0.9°C. |
| 7 | A2 | 2000 ppm B2 | 50% naphtha | 1.7°C. |
| 8 | A2 | 2000 ppm B1 | 30% naphtha | 7.6°C. |
| 9 | A2 | 5000 ppm B1 | 30% naphtha | 6.4°C. |
| 10 | A2 | 5000 ppm B3 | 30% naphtha | 5.0°C. |
| C1 | A1 | — | 50% naphtha | −27.0°C. |
| C2 | A2 | — | 50% naphtha | 3.3°C. |
| C3 | A2 | — | 30% naphtha | 10.6°C. |

MS is a mixture of a series of aliphatic and cyclic, non-aromatic hydrocarbons. The main constituents of MS are shown in the following table:

TABLE 5

Constituents of MS

| Constituent | Concentration range (% by weight) | | |
|---|---|---|---|
| Di-2-ethylhexyl ether | 10 | — | 25 |
| 2-Ethylhexyl 2-ethylhexanoate | 10 | — | 25 |
| $C_{16}$-lactones | 4 | — | 20 |
| 2-Ethylhexyl butyrate | 3 | — | 10 |
| 2-Ethyl-1,3-hexanediol mono-n-butyrate | 5 | — | 15 |
| 2-Ethylhexanol | 4 | — | 10 |
| $C_4$- to $C_8$-acetates | 2 | — | 10 |
| 2-Ethyl-1,3-hexanediol | 2 | — | 5 |
| Ethers and esters $\geqq C_{20}$ | 0 | — | 20 |

Lubricity in Middle Distillates

TABLE 2

Storage experiment at −22° C. (unless stated otherwise), solution in solvent naphtha

| Example | Constituent A | Constituent B | Amount of B | After 1 day | After 3 days | After 5 days | After 7 days | After 1 day at −28° C. |
|---|---|---|---|---|---|---|---|---|
| 11 | A1 | B1 | 100 ppm | clear, no sediment | clear, no sediment | clear, no sediment | clear, about 10 specks on the base | clear, sediment (crystalline) |
| 12 | A1 | B1 | 500 ppm | clear, no sediment | clear, no sediment | clear, no sediment | clear, no sediment | clear, no sediment |
| 13 | A1 | B1 | 1 000 ppm | clear, no sediment | clear, no sediment | clear, no sediment | clear, no sediment | clear, no sediment |
| 14 | A1 | B1 | 5 000 ppm | clear, no sediment | clear, no sediment | clear, no sediment | clear, no sediment | clear, no sediment |
| 15 | A1 | B1 | 10 000 ppm | clear, no sediment | clear, no sediment | clear, no sediment | clear, no sediment | clear, no sediment |
| 16 | A1 | B1 | 50 000 ppm | clear, no sediment | clear, no sediment | clear, no sediment, only flowable after shaking, viscous | clear, no sediment, only flowable after shaking, viscous | clear, no sediment only flowable after shaking, viscous |

TABLE 3

Storage experiment at −22° C. (unless stated otherwise), solution in MS

| Example | Constituent A | Constituent B | Amount of B | After 3 days | After 7 days | After 1 day at −28° C. |
|---|---|---|---|---|---|---|
| 17 | A1 | B1 | 1 000 ppm | clear, no sediment | clear, no sediment | Cloudy, no sediment |
| 18 | A1 | B1 | 5 000 ppm | clear, no sediment | clear, no sediment | Cloudy, no sediment |
| 19 | A1 | B1 | 10 000 ppm | clear, no sediment | clear, no sediment | Cloudy, no sediment |
| 20 | A1 | B1 | 50 000 ppm | slightly cloudy, no sediment, not flowable | slightly cloudy, no sediment, not flowable | slightly cloudy, no sediment, not flowable |

TABLE 4

Storage experiment at −22° C. (unless stated otherwise), solution in MS

| Example | Constituent A | Constituent B | Amount of B | After 3 days | After 7 days |
|---|---|---|---|---|---|
| 21 | A1 | B1 | 500 ppm | clear, sediment (crystalline) | clear, sediment (crystalline) |
| 22 | A1 | B1 | 2 000 ppm | clear, no sediment | clear, no sediment |
| 23 | A1 | B1 | 10 000 ppm | clear, no sediment | clear, no sediment |
| 24 | A1 | B1 | 50 000 ppm | slightly cloudy, no sediment, not flowable | slightly cloudy, no sediment, not flowable |

The lubricity of the fatty acid mixtures was measured on additive-containing oils at 60° C. by means of an HFRR instrument from PCS Instruments. The high frequency reciprocating rig (HFRR) test is described in D. Wei, H. Spikes, Wear, Vol. 111, No. 2, p. 217, 1986. The results are given as the friction coefficient and wear scar (WS 1.4). A low friction coefficient and a low wear scar indicate good lubricity.

TABLE 6

Characterization of the test oils:
In order to test the lubricity, a test oil having the following characteristics was employed:

| | Test Oil 1 |
|---|---|
| Boiling range | 188–285° C. |
| Density | 0.810 g/cm$^3$ |
| Cloud point | −29° C. |
| Sulfur content | 3 ppm |
| Wear scar | 626 $\mu$m |
| Friction | 0.375 |

The boiling characteristics were determined in accordance with ASTM D-86, cloud point was determined in accordance with ISO 3015.

TABLE 7

Wear scar in Test Oil 1

| Example | Additive | Metering | Wear scar | Friction |
|---|---|---|---|---|
| 25 | according to V1 | 200 | 466 | 0.196 |
| 26 | according to V1 | 400 | 402 | 0.167 |
| 27 | according to Example 3 | 200 | 443 | 0.194 |
| 28 | according to Example 3 | 400 | 395 | 0.166 |
| 29 | according to Example 4 | 400 | 409 | 0.168 |

What is claimed is:

1. A low-temperature-stabilized fatty acid mixture comprising

A) from 10 to 99.99% by weight of a fatty acid mixture comprising

A1) from 1 to 99% by weight of at least one saturated mono- or dicarboxylic acid having 6 to 50 carbon atoms, A2) from 1 to 99% by weight of at least one unsaturated mono- or dicarboxylic acid having 6 to 50 carbon atoms, in which the fatty acid mixture of A1) and A2) has an iodine number of at least 40 g of l/100 g and B) from 0.01 to 90% by weight of copolymers comprising B1) from 40 to 60 mol % of bivalent structural units of the formula B1 a)

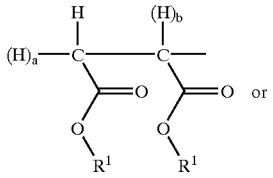

-continued

B1 b)

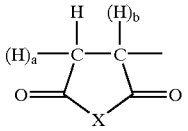

where X=O or N—$R^1$, in which a and b=0 or 1 and a+b=1, and

B2) from 60 to 40 mol % of bivalent structural units of the formula $$—H_2C—CR^2R^3—$$ B2 and, if desired,

B3) from 0 to 20 mol % of bivalent structural units derived from polyolefins, where the polyolefins can be derived from monoolefins having 3 to 5 carbon atoms, and in which a) $R^1$ is an alkyl or alkenyl radical having from 10 to 40 carbon atoms or an alkoxyalkyl radical having from 1 to 100 alkoxy units and from 1 to 30 carbon atoms in the alkyl radical, and b) $R^3$ is a radical of the formula $OCOR^4$ or $COOR^4$, in which $R^4$ is $C_1$–$C_{24}$-alkyl, and c) the number of carbon atoms in the polyolefin molecules on which the structural units B3) are based is from 35 to 350, and d) $R^2$ is hydrogen or methyl.

2. A low-temperature-stabilized fatty acid mixture as claimed in claim 1, in which constituent A comprises carboxylic acids having from 12 to 22 carbon atoms.

3. A low-temperature-stabilized fatty acid mixture as claimed in claim 1, comprising from 1 to less than 20% by weight of A1) and from greater than 80 to 99% by weight of A2).

4. A low-temperature-stabilized fatty acid mixture as claimed in claims 1, in which the mixture of A1) and A2) has an iodine number of at least 40 g of l/100 g.

5. A low-temperature-stabilized fatty acid mixture as claimed in claim 1, in which the mixture of A1) and A2) comprises from 1 to 40% by weight of resin acids.

6. A low-temperature-stabilized solution of a substance as claimed in claim 1 in an organic solvent, where the solution comprises from 1 to 80% by weight of solvent.

7. A low-temperature-stabilized solution as claimed in claim 6, where the solvent used is an aliphatic and/or aromatic and/or oxygen-containing hydrocarbon.

8. A fuel oil comprising a middle distillate having a sulfur content of up to 0.05% by weight and an additive as claimed in claim 1.

9. A method for improving the lubrication properties of low-sulfur middle distillates having a sulfur content of up to 0.05% by weight, said method comprising adding to the low-sulfur middle distillates the additive of claim 1.

* * * * *